United States Patent [19]

Lyons, Jr.

[11] Patent Number: 4,603,517

[45] Date of Patent: Aug. 5, 1986

[54] CORNER PATCH SUPPORT

[75] Inventor: George W. Lyons, Jr., Madison, Conn.

[73] Assignee: The Bilco Company, New Haven, Conn.

[21] Appl. No.: 692,529

[22] Filed: Jan. 18, 1985

[51] Int. Cl.[4] ..... E04D 13/14

[52] U.S. Cl. ..... 52/60; 52/96; 52/219; 52/288

[58] Field of Search ..... 52/58, 60, 96, 270, 52/288, 219; 285/43, 44, 42

[56] References Cited

U.S. PATENT DOCUMENTS

| | | | |
|---|---|---|---|
| 618,074 | 1/1899 | Dyer | 52/58 |
| 1,875,640 | 9/1932 | Moore | 52/58 X |
| 3,065,572 | 11/1962 | Weingartner | 52/96 X |
| 3,838,544 | 10/1974 | Hindall | 52/60 |
| 4,112,632 | 9/1978 | Simpson | 52/60 X |
| 4,462,190 | 7/1984 | Allen | 52/58 |

FOREIGN PATENT DOCUMENTS

| | | | |
|---|---|---|---|
| 98982 | 8/1964 | Denmark | 52/58 |
| 579431 | 7/1933 | Fed. Rep. of Germany | 52/58 |
| 1904755 | 12/1970 | Fed. Rep. of Germany | 52/219 |
| 2055890 | 5/1972 | Fed. Rep. of Germany | 52/219 |
| 2910610 | 9/1980 | Fed. Rep. of Germany | 52/219 |
| 2951275 | 7/1981 | Fed. Rep. of Germany | 52/58 |
| 2449176 | 10/1980 | France | 52/60 |
| 833539 | 4/1960 | United Kingdom | 52/58 |

*Primary Examiner*—John E. Murtagh
*Assistant Examiner*—Richard E. Chilcot, Jr.
*Attorney, Agent, or Firm*—DeLio & Associates

[57] ABSTRACT

Disclosed is a corner gap support used in conjunction with flashing applied to seal the seams created at the junction of a housing erected around a port in a surface, with said surface. As fabricated, the device is adapted both to fill corner gaps in said flashing and to act as a support for patching material used to seal said gaps.

7 Claims, 9 Drawing Figures

CORNER PATCH SUPPORT

BACKGROUND OF THE INVENTION

This invention relates generally to sheet metal connectors and more particularly to a support adapted to fill corner base gaps in flashing, and further to support patches which are applied to cover over and seal said gaps.

In the construction industry one recurring problem is that of sealing the intersection of a housing, such as a dormer or scuttle which is erected around a hole or port cut into a planar surface such as the roof of a building. Typically, the seam where the surface and housing meet is covered over and, more or less sealed off with aluminum, copper or galvanized steel flashing. As fabricated, such flashing normally comprises base and wall planar portions disposed more or less at a right angle to each other, each portion being adapted to bear upon the particular surface adjacent thereto. Connecting these two portions is an intermediate angular section, the angle and width of which will be a function of the ductility and thickness of the strip stock used to fabricate the flashing. In use, the flashing is normally nailed or otherwise fastened in place to the base planar surface and the housing walls. Where more sealing is needed, a bead of silicone, tar or other sealing material can be laid down along the two edges of the flashing to close off any air gaps which might exist. Where greater corrosion protection is required, the flashing may be covered with a vinyl plastic coating on the external surface. Techniques for producing and using such materials are well known in the construction industry.

When the surfaces being joined are substantially planar, few problems arise from the use of said flashing as described above. However, at the external corners where two walls on the housing intersect and abut at some angle, usually a right angle, a gap will arise in the flashing, at the point where the abutting walls join the underlying planar base surface, due to the divergence of the base and intermediate portions of the flashing. A normal practice is to cover over this gap with a plastic or tar patch which substantially covers this gap and seals it. However, while the patch is supported by the surface and walls to which it is attached, the portion lying over the gap in the intermediate angled section of the flashing is usually unsupported so that it presents an easily punctured point of weakness in the composite structure.

OBJECTS OF THE INVENTION

It is the primary object of the present invention to provide a new and improved support for patches used to seal corner joints in flashing.

It is a further object of the present invention to provide a new and improved support for corner patches which can be easily and inexpensively fabricated in the field.

A feature of the present invention is that it provides a patch support to which said patch may be tacked so as to firmly fix its position relative to said corner joint.

An advantage of the present invention is that when used, the integrity of a corner point in flashing is equal to that of the remainder of the structure.

These and other objects, features and advantages of the invention will be apparent from a consideration of the illustrations and specifications which follow.

SUMMARY OF INVENTION

The above objects, features and advantages are met by a support for patches used to cover base gaps arising at the corners of flashing used to seal the junction of a housing erected around a port cut into a planar surface, with said surface, said flashing being attached both to said surface and to said housing, said support being adapted for placement over said base gap and comprising:

(a) mating means adapted to engage said surface and to fit over a portion of said flashing on either side of said base gap; and (b) cover means extending from said mating means and adapted to cover said base gap, said support being further adapted to provide a tacking point for a patch which when fitted over said support will provide a leak free corner joint for said housing.

DETAILED DESCRIPTION OF THE INVENTION

Figure 1:
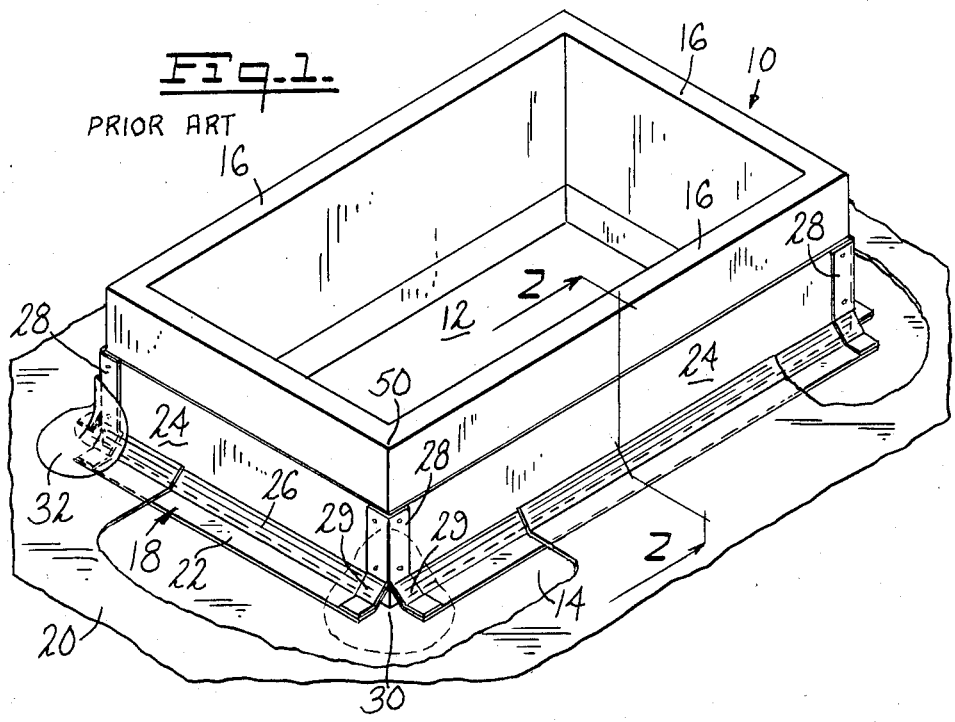
Fig. 1. PRIOR ART
FIG. 1 is an isometric view of a typical housing erected on a planar surface such as a roof.

Turning now to FIG. 1, a housing 10, which has been erected around an opening or port 12 cut into planar surface 14, is shown. Typically, such a housing comprises at least one (for rounded ports) and, more usually, four (for rectangular or square shaped ports) more or less vertically disposed walls 16 which are sized and positioned so as to rest upon the portion of planar surface 14 which lies immediately adjacent to port 12. Customarily, the open seam at the junction line between the base of each of walls 16 and surface 14 is closed off and sealed with one or more strips of flashing 18. Such flashing which is typically made from materials such as aluminum, galvanized steel, copper, weather resistant flexible plastics such as polypropylene and the like, is readily available. Further, to provide both corrosion protection and an enhanced sealing capability supplementary roof sealants such as a vinyl coating 20 applied over the base metal of the flashing may be used. When planar surface 14 is also covered with such a sealant, bonding of the roof sealant to the flashing acts to provide an extra measure of leak tightness in the composite structure.

Figure 2:
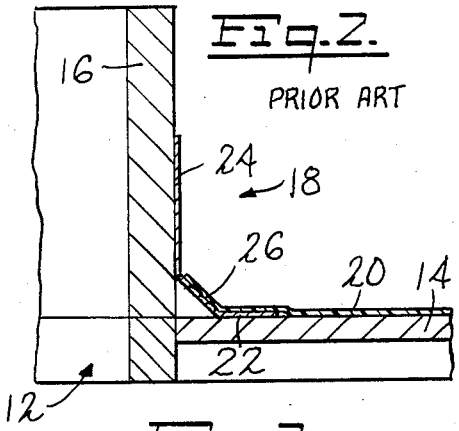
Fig. 2. PRIOR ART
FIG. 2 is a cross section taken along line 2—2 of FIG. 1 showing the arrangement of the flashing relative to the walls of the housing and the planar surface.

As shown in detail in FIG. 2, flashing 18 comprises base or horizontally disposed planar portion 22 which is adapted to extend over and bear upon wall 16. Providing a transition between and connecting these two portions is intermediate portion 26. It should be understood that the use of the terms horizontal and vertical are used hereinabove and are merely representative of the relative disposition of these two portions and are not an absolute limitation upon the placement of the flashing when used as herein described. The flashing is customarily held in place by nailing or screwing the horizontal and vertical portions of the flashing to corresponding areas of the adjacent surfaces. Where additional sealing is needed, the edges of the flashing/wall or surface interface may be covered with a sealant (not shown) such as tar, putty, silicone rubber and the like to prevent water from leaking through.

When housing 10 has a plurality of walls 16, the structure further may also comprise corner supports 28 to reinforce the housing structure where two of the walls abut each other and facilitate the handling of housing 10 when it is shop fabricated and brought to the construction site as a more or less completed structure. Where flashing is an integral part of the structure, angular corner support 28 may also include a pair of flaps 29 adapted to engage, cover over the end of and be sealable to the mating sections of intermediate portion 26.

While the fabrication technique described above provides satisfactory sealing along the flat sides of walls 16, it is found that where the planes of two abutting walls cross each other on planar surface 14, the divergence of the two base portions 22 and intermediate portions 26 of the adjacent portions of flashing 18 creates a gap 30 between them. Customarily, the gap is covered over with a patch 32, usually of a vinyl material, which is configured to engage both the two abutting sides of housing 10 and the adjacent areas of planar surface 14 and be sealable thereto so as to preserve the overall sealing integrity of the flashing. However, it is often found that such a construction is not entirely satisfactory since the part of patch 32 which lies directly over gap 30 is unsupported and is easily punctured.

Figure 3:
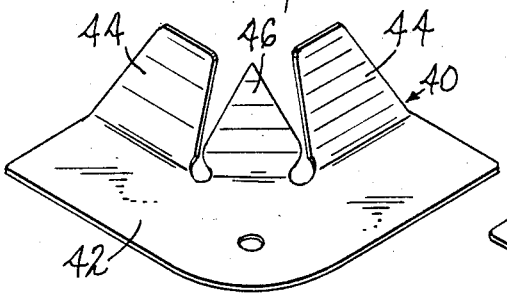
FIG. 3 is an isometric view of a first embodiment of the support of the present invention.
Figure 4:
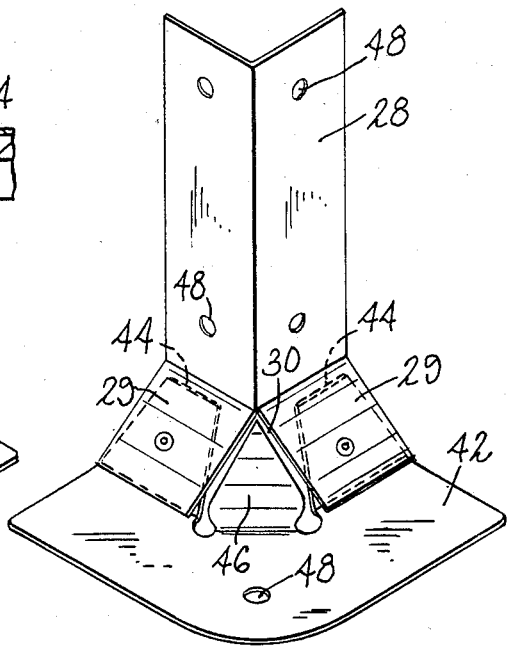
FIG. 4 is an isometric view showing the combination of the support of FIG. 3 to a corner support for the housing of FIG. 1.
Figure 5:
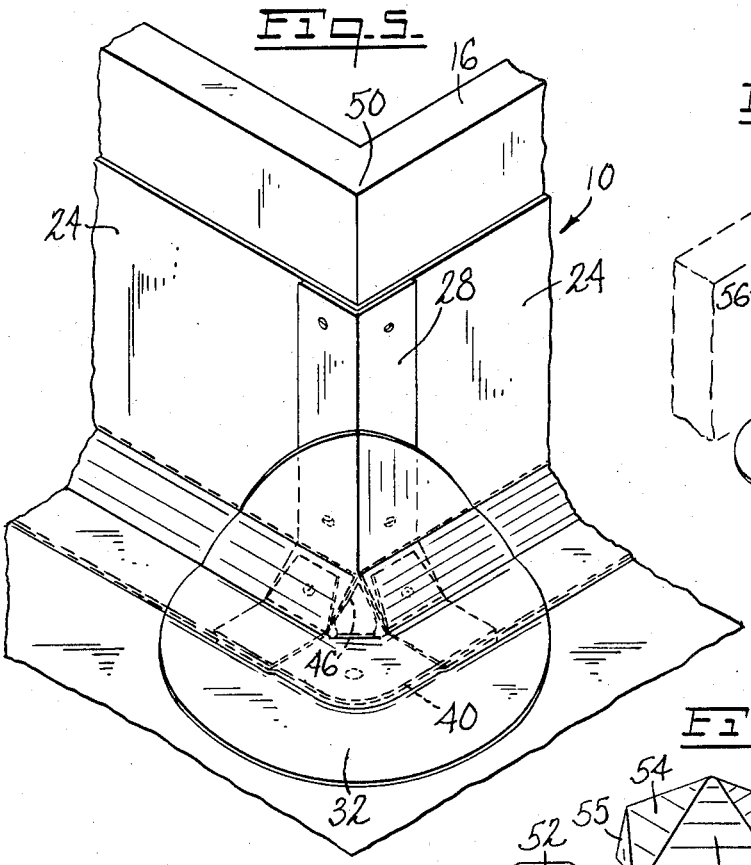
FIG. 5 is an isometric view showing the placement of support of FIG. 3 and a sealing patch on the housing of FIG. 1.

The problem as elucidated above is solved with support 40 of the present invention, one embodiment of which is shown in FIG. 3. As shown, this comprises base means 42, having at the left and right sides thereof, a pair of angular connectors 44 which are disposed to materially engage either of the two flaps 29 of flashing 18. Situated between connectors 44 is corner support 46 which is more or less triangular shaped and angularly disposed so as to fit into and substantially fill gap 30 when placed in position. Such a placement is shown in FIGS. 4 and 5. FIG. 4 shows a combination of support 40 and angular corner support 28 with angular connectors 44 being located beneath flaps 29 for better sealing of the composite structure. As shown, the composite structure also has a number of strategically placed holes 48 to facilitate joining the structure to both surface 14 and to housing 10, thus firmly fixing it in place. FIG. 5 is an enlarged view of a corner 50 in housing 10 showing the final placement of the composite structure shown in FIG. 4 and further showing the position of a patch 32 which has been placed thereon, relative to each of walls 16, the abutting portion of flashing 18 and planar surface 14. As shown, the portion of patch 32 which lies over support 46 is now fully supported and no longer represents an area of weakness in the finished structure.

Preferably, support 40 is covered with a vinyl or other heat sealable material so that the patch material over support 46 may be easily heat sealed thereto. By so doing, patch 32 is centered and firmly fixed in place before final sealing to side walls 16 and floor surface 14. When this is done, it is found that the mass of support 46 acts as a heat sink so that burn holes in the patch material, particularly over gap 30, do not form as a result of the heating. As a result, the overall integrity of the patch is enhanced.

Figure 6:
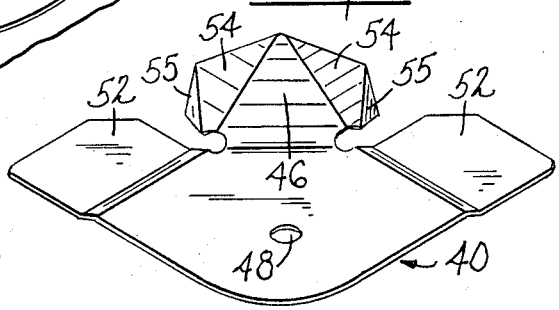
FIG. 6 is an isometric view of a second embodiment of the present invention.
Figure 7:
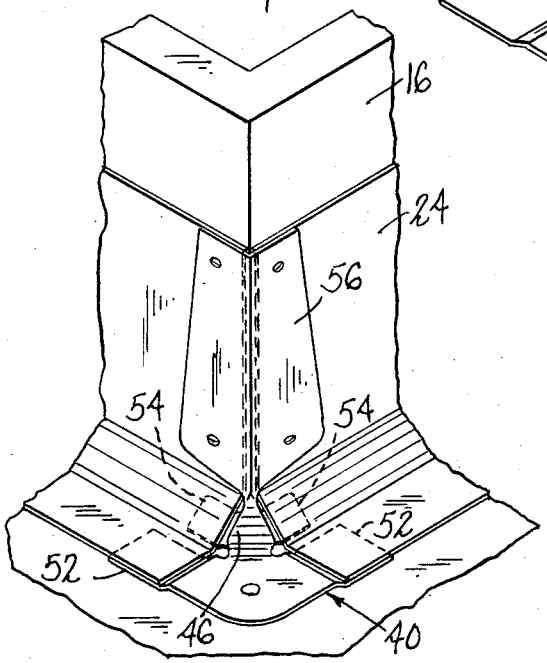
FIG. 7 is an isometric view of the support of FIG. 6 when set in place.

Turning now to FIGS. 6, 7, 8 and 9, other embodiments of the present invention are shown. In FIG. 6, the embodiment of base section 42 has extension offsets 52 while gap support 46 has a pair of angled extensions 54 attached thereto. As shown in FIG. 7, these extensions are adapted to fit underneath the ends of the base and intermediate portions of flashing 18 being joined, thus providing a continuous support surface which smoothly travels around and fills gap 30 at corner 50.

Also shown are a pair of side legs 55 which are attached to the sides of corner support 46. These act to prevent support 46 from being inadvertently depressed so that patch 32 would not rest upon it. It is understood that while legs 55 are shown as a part of this particular embodiment, such a feature can readily be incorporated into any of the various embodiments shown herein.

The embodiment shown at FIG. 7 differs from that shown in FIG. 6 in that corner support 56 is integral with the base and gap support portions so that a single, unitary corner support is provided rather than having such support being provided by two separate pieces, as shown in FIG. 5.

Figure 9:
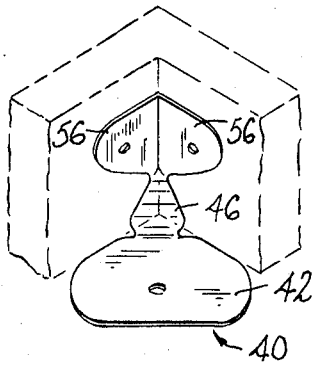
FIG. 9 is an isometric view of a fourth embodiment of the present invention.
Figure 8:
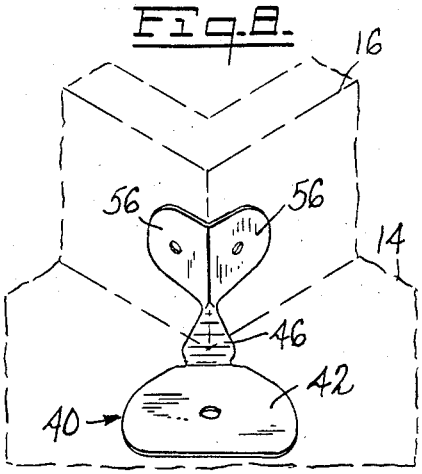
FIG. 8 is an isometric view of a third embodiment of the present invention.

Still other embodiments of the present invention are shown in FIGS. 8 and 9. As depicted,in both of these base portion 42 and integral corner support 56 are shortened relative to the embodiment shown in FIG. 7.

This construction is readily adaptable for use in either acute (FIG. 8) or obtuse (FIG. 9) angled corners of housing 10 particularly when both planar surface 14 and vertical walls 16 are covered with a heat sealable roofing material such as polyvinyl chloride (PVC). In a preferred embodiment, support 40 further has an adhesive applied to its underside. By so doing, the patch support can be positively and firmly positioned against both surface 14 and walls 16 during the installation of housing 10.

It will thus be seen that the objects set forth above, among those made apparent from the preceding description, are efficiently attained and, since certain changes may be made in the above article without departing fromt he spirit and scope of the invention, it is intended that all matter contained in the above description and shown in the accompanying drawings shall be interpreted as illustrative and not in a limiting sense.

What is claimed is:

1. A corner patch support for heat sealable plastic patches used to cover corner base gaps arising from the use of flashing applied to the intersection of a planar surface with the walls of a housing erected on the surface, said flashing having upper and lower substantially planar portions adapted to bear upon and be sealable to the surface and the walls and an intermediate angular connecting portion, said support being adapted to fill a gap in said flashing arising at the intersection of the walls, said support comprising:

a base adapted to overlie the planar surface at the gap;

angled supports extending from said base adapted to bear upon the intermediate flashing portions adjacent to the gap; and an angled corner extending from said base and configured to fit into and substantially fill the portion of the gap lying between the adjacent intermediate flashing portions, the corner patch suport further having a coating adapted to supply a firm tacking point for said patch, whereby the patch can be sealed thereto so that a substantially smooth transition is made from the flashing portions on one side of the gap to the corresponding flashing portions on the other side of the gap and said patch is firmly supported in a leak-free fashion.

2. A corner patch support for plastic patches used to cover base gaps arising at the corners of flashing placed along the lower portions of the walls of a structure and over the intersection of the walls with a planar surface, the flashing having an upper portion and a lower portion connected by an intermediate portion, the corner patch support comprising:

a base adapted to overlie the planar surface at the gap;

angled supports extending from said base adapted to bear upon the intermediate flashing portions adjacent to the gap; and an angled corner extending from said base and configured to fit into and substantially fill the portion of the gap lying between the adjacent intermediate flashing portions, whereby a substantially smooth transition is made from the flashing portions on one side of the gap to the corresponding flashing portions on the other side of the gap so that when a patch is placed thereover, it is firmly supported in a leak-free fashion.

3. The corner patch support of claim 2 wherein said angle supports further comprise upright portions adapted to bear upon the upper portions of the flashing on either side of the gap.

4. The corner patch support of claim 2 further comprising a vinyl coating on at least one side thereof.

5. The corner patch support of claim 2 wherein a portion of said base is offset to bear upon and close the portion of the gap on the planar surface.

6. The support of claim 2 wherein the corner patch portions of the support which engage said planar surface and said housing are coated with an adhesive.

7. The corner patch support of claim 2 wherein the angled corner further comprises support legs.

* * * * *

UNITED STATES PATENT AND TRADEMARK OFFICE

CERTIFICATE OF CORRECTION

PATENT NO. : 4,603,517

DATED : August 5, 1986

INVENTOR(S) : George W. Lyons, Jr.

It is certified that error appears in the above-identified patent and that said Letters Patent is hereby corrected as shown below:

Column 4, line 50, "fromt he" should be -- from the --.

Column 5, line 4, "suport" should be -- support --.

Signed and Sealed this

Twenty-eighth Day of October, 1986

[SEAL]

*Attest:*

DONALD J. QUIGG

*Attesting Officer*

*Commissioner of Patents and Trademarks*